US011569604B2

(12) United States Patent
Kobayashi et al.

(10) Patent No.: US 11,569,604 B2
(45) Date of Patent: Jan. 31, 2023

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Shingo Kobayashi, Mie (JP); Sunghyun Byun, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 8 days.

(21) Appl. No.: 17/294,023

(22) PCT Filed: Nov. 8, 2019

(86) PCT No.: PCT/JP2019/043831
§ 371 (c)(1),
(2) Date: May 14, 2021

(87) PCT Pub. No.: WO2020/100731
PCT Pub. Date: May 22, 2020

(65) Prior Publication Data

US 2022/0013945 A1 Jan. 13, 2022

(30) Foreign Application Priority Data

Nov. 16, 2018 (JP) ..... JP2018-215244

(51) Int. Cl.
*H01R 13/42* (2006.01)
*H01R 13/44* (2006.01)

(52) U.S. Cl.
CPC ..... *H01R 13/42* (2013.01); *H01R 13/44* (2013.01)

(58) Field of Classification Search
CPC .. H01R 13/44; H01R 2201/26; H01R 13/502; H01R 13/4538; H01R 13/04
See application file for complete search history.

(56) References Cited

U.S. PATENT DOCUMENTS 2,537,370 A * 1/1951 Parnes ..... H01R 13/44 439/693
3,781,913 A * 12/1973 Liburdi ..... H01R 13/60 439/692

(Continued)

FOREIGN PATENT DOCUMENTS

JP S58-147180 U 10/1983
JP H09-306578 A 11/1997

(Continued)

OTHER PUBLICATIONS

International Search Report dated Jan. 7, 2020 for WO 2020/100731 A1 (4 pages).

*Primary Examiner* — Truc T Nguyen
(74) *Attorney, Agent, or Firm* — Venjuris, P.C.

(57) ABSTRACT

A connector is provided with a terminal member including a conductive terminal body in the form of a wide flat plate and a terminal protecting portion mounted on the terminal body, and a housing provided separately from the terminal member and including a terminal holding portion for holding the terminal member. The terminal protecting portion includes a pair of side edge covering portions for partially covering parts of both side surfaces in a front-back direction of the terminal body. The terminal holding portion is provided with a terminal insertion recess through which the terminal member is to be fit. The side edge covering portions are so fit in the terminal insertion recess as to be able to (Continued)

contact the terminal holding portion with the terminal member fit in the terminal insertion recess and assembled with the terminal holding portion.

7 Claims, 9 Drawing Sheets

(56) References Cited

U.S. PATENT DOCUMENTS

| | | | | |
|---|---|---|---|---|
| 6,146,211 | A * | 11/2000 | Okamoto | H01R 13/44 439/825 |
| 8,298,022 | B2 * | 10/2012 | Tsuruta | H01R 13/4365 439/948 |
| 10,541,490 | B2 * | 1/2020 | Reedy | H01R 13/20 |
| 10,855,018 | B2 * | 12/2020 | Duenkel | B60L 50/50 |
| 11,387,589 | B2 * | 7/2022 | Shimizu | H01R 13/44 |
| 2013/0090012 | A1 * | 4/2013 | Natter | H01R 13/04 29/874 |
| 2016/0064849 | A1 * | 3/2016 | Eckel | H01R 24/66 439/135 |
| 2018/0294600 | A1 * | 10/2018 | Loncar | H01R 13/44 |
| 2019/0386423 | A1 * | 12/2019 | Miyazawa | H01R 13/5202 |
| 2022/0221749 | A1 * | 7/2022 | Wu | G02F 1/167 |

FOREIGN PATENT DOCUMENTS

| | | | |
|---|---|---|---|
| JP | 2002-050428 | A | 2/2002 |
| JP | 2005-259507 | A | 9/2005 |
| JP | 2005-327632 | A | 9/2005 |

* cited by examiner

CONNECTOR

CROSS REFERENCE TO RELATED APPLICATIONS

This application is a national phase of PCT application No. PCT/JP2019/043831, filed on 8 Nov. 2019, which claims priority from Japanese patent application No. 2018-215244, filed on 16 Nov. 2018, all of which are incorporated herein by reference.

TECHNICAL FIELD

A technique disclosed by this specification relates to a connector.

BACKGROUND

For example, a connector element for high current and high voltage is known from JP 2016-522550A (Patent Document 1 below). This connector element includes a contact element in which a part of a flat conductive contact member longer in a front-back direction than in a lateral direction is covered by an insulating contact protecting member, and a housing for holding the contact element.

The contact protecting member covers an upper end part of the contact member and a front edge part of the contact member over an entire length, and both side surfaces in a plate thickness direction and a back edge part of the contact member in the contact element are exposed. On the other hand, the housing is integrally molded to the contact protecting member by insert molding, and a base end part of a front side contact protecting member covering the front edge part of the contact member and the housing are connected. Further, the housing includes a contact protecting collar open upward and forward to cover the both side surfaces of the contact member and the back side edge of the contact member where the contact member is exposed in the contact element, and a clearance between the contact protecting collar and the contact protecting member is so dimensioned that fingers cannot directly touch the contact member.

PRIOR ART DOCUMENT

Patent Document

Patent Document 1: JP 2016-522550A

SUMMARY OF THE INVENTION

Problems to be Solved

In the above connector element, the contact protecting member is molded around the contact member by insert molding and, in addition, the housing is also formed by insert molding. Thus, a mold for molding the connector element becomes complicated. Further, if the design of either the contact element or the housing is changed, a mold for the entire connector element has to be newly fabricated.

Accordingly, a connector has been studied which is formed by individually forming a terminal member including a connecting portion covering an upper end part and parts of both front and back surfaces of a terminal body in the form of a flat plate wide in a front-back direction by a terminal protecting portion and a housing for holding the terminal member, and assembling the terminal member with the housing.

However, since the terminal protecting portion of the terminal member and the housing are separate bodies, there is a concern that the terminal protecting portion is detached from the terminal body if such a force as to pry a side edge part of the terminal member is generated in connecting and separating the connector to and from another connector.

A technique for suppressing the detachment of a terminal protecting portion in a terminal member is disclosed in this specification.

Means to Solve the Problem

The technique disclosed by this specification is directed to a connector to and from which a mating connector is connectable and separable, the connector including a terminal member including a conductive terminal body and an insulating terminal protecting portion mounted on the terminal body, and a housing provided separately from the terminal member, the housing including a terminal holding portion for holding the terminal member in a projecting state at a position where the mating connector is to be connected, wherein the terminal protecting portion includes a side edge covering portion for partially covering a side part extending along a projecting direction of the terminal body, the terminal holding portion is provided with a terminal insertion recess, the terminal member being fit into the terminal insertion recess, and the side edge covering portion is so fit in the terminal insertion recess as to be able to contact the terminal holding portion in a direction intersecting a connecting direction with the terminal member fit in the terminal insertion recess and assembled with the terminal holding portion.

According to the connector thus configured, since the terminal member and the housing are individually formed, it can be suppressed that molds for forming the respective members become complicated. Further, even if the design of either the terminal member or the housing is changed, the new fabrication of a mold for the entire connector can be prevented by newly fabricating only either one of the molds.

Further, since the side edge covering portion for covering the side part extending along the projecting direction of the terminal body can be fit into the terminal insertion recess and contact the terminal holding portion, the detachment of the terminal protecting portion from the terminal body can be suppressed by the contact of the side edge covering portion and the terminal holding portion even if a prying force acts on the side edge covering portion in connecting and separating the mating connector.

The connector disclosed by this specification may be configured as follows.

The terminal body may project along the connecting direction to and a separating direction from the mating connector.

If the terminal body projects along the connecting direction to and the separating direction from the mating connector, a prying force easily acts on the terminal body in a rotating direction about the connecting and separating directions to connect and separate the mating connector. Thus, if the terminal body projects along the connecting direction to and separating direction from the mating connector, a technique for suppressing the detachment of the terminal protecting portion from the terminal body by the contact of the side edge covering portion with the terminal holding portion is very effective.

The terminal body may be in the form of a plate having a plate thickness smaller than a width, the terminal protecting portion may further include an end covering portion to be fit to a projecting end part of the terminal body, and the side edge covering portions may be so provided on the side parts on both sides in a width direction of the terminal body as to be connected to the end covering portion.

If the plate thickness of the terminal body is smaller than the width thereof, the side edge covering portions provided on the side parts in the width direction of the terminal body are easily detached from the terminal body.

However, since the side edge covering portions can contact the terminal holding portion in the direction intersecting the connecting direction, the detachment of the side edge covering portions from the terminal body can be suppressed even if a prying force acts on the side edge covering portions.

Further, since an end part of each side edge covering portion opposite to an end part to be held in contact with the terminal holding portion is connected to the end covering portion to be fit to the projecting end part of the terminal body, the detachment of the side edge covering portions from the terminal body can be further suppressed.

A tip part of the side edge covering portion may be located inside the terminal holding portion.

The tip part of the side edge covering portion is relatively easily deformed. Accordingly, in the present disclosure, the tip part of the side edge covering portion is located inside the terminal holding portion. In this way, the contact of external matters with the tip part of the side edge covering portion is suppressed. As a result, the deformation of the tip part of the side edge covering portion due to the contact of an external matter with the tip part of the side edge covering portion is suppressed, wherefore the detachment of the side edge covering portion from the terminal body can be further suppressed.

A retaining portion may project on the tip part of the side edge covering portion, and a retaining recess fittable to the retaining portion may be recessed on the side part of the terminal body.

The tip part of the side edge covering portion is relatively easily deformed. Accordingly, in the present disclosure, the retaining portion provided on the tip part of the side edge covering portion and the retaining recess provided on the terminal body are formed to be fittable to each other. Since the detachment of the tip part of the side edge covering portion from the terminal body is suppressed in this way, the detachment of the side edge covering portion from the terminal body can be further suppressed.

The terminal member may include a locked portion for preventing the terminal member from escaping toward the mating connector by contacting a terminal locking portion provided on the terminal holding portion when the terminal member reaches a proper fitting position with respect to the terminal insertion recess.

According to this configuration, the terminal member can be retained at a proper position with respect to the terminal holding portion and the side edge covering portion can be reliably fit into the terminal insertion recess. In this way, the detachment of the terminal protecting portion from the terminal body can be reliably suppressed.

A thickness in a front-back direction of a wall portion for covering the terminal member in the terminal insertion recess may be set to be larger than a thickness of the side edge covering portion covering the terminal body.

According to this configuration, since the thickness of the wall portion for covering the terminal member in the terminal insertion recess is larger than the thickness of the side edge covering portion, the terminal holding portion can firmly support the side edge covering portion even if a prying force acts on the side edge covering portion. In this way, the detachment of the terminal protecting portion from the terminal body can be further suppressed.

The housing may include a receptacle-like fitting tube portion connected to the terminal holding portion and having a fitting opening, the mating connector being fit into the fitting opening, and the fitting tube portion may include a side opening communicating with the fitting opening and open in the width direction of the terminal body.

If the fitting tube portion includes the side opening communicating with the fitting opening as in this configuration, there is a concern that a larger prying force acts on the side edge covering portion than, for example, with a fitting tube portion including only a fitting opening, when the mating connector is connected and separated.

However, according to the above configuration, the side edge covering portion can be fit into the terminal insertion recess and contact the terminal holding portion. This is very effective in suppressing the detachment of the side edge covering portion even if the fitting tube portion includes the side opening.

With the terminal member fit in the terminal insertion recess and assembled with the terminal holding portion, the pair of side edge covering portions may be both matched and fit in the terminal insertion recess.

According to this configuration, since the pair of side edge covering portions for covering the both side surfaces of the terminal body are both fit in the terminal insertion recess, the detachment of the terminal protecting portion from the terminal body when a prying force acts on the side edge covering portions can be suppressed as compared to the case where only one of the pair of side edge covering portions is fit in the terminal insertion recess.

The fitting tube portion may include a wall portion for covering another side surface disposed opposite to one side surface disposed on the side of the side opening, out of both side surfaces in the width direction of the terminal body, from the other side surface side, retaining recesses capable of contacting retaining portions projecting on the side edge covering portions may be respectively recessed on the both side surfaces in the width direction of the terminal body, of the other side edge covering portion for covering the other side surface of the terminal body, out of the pair of side edge covering portions, may be formed to be shorter in the connecting direction than one side edge covering portion for covering the one side surface of the terminal body, out of the pair of side edge covering portions, and the both retaining recesses of the terminal body may be formed to be shifted in the connecting direction.

If the retaining recesses are respectively recessed on the both side surfaces of the terminal body as in this configuration, a cross-sectional area of the terminal body in a part where retaining recesses are provided is reduced, if the retaining recesses are provided at the same position in the connecting direction. Thus, electrical resistance in the part having a reduced cross-sectional area increases and the amount of heat generation of the terminal body increases.

However, since the retaining recesses in the terminal body are formed to be shifted in the connecting direction according to the above configuration, a reduction in the cross-sectional area of parts of the terminal body where the retaining recesses are provided can be suppressed. In this way, it is possible to suppress an increase in the electrical resistance of the parts of the terminal body where the retaining recesses are provided and suppress an increase in the amount of heat generation in the terminal body.

Further, since the other side surface of the terminal body is covered from the other side surface side by the covering wall portion of the fitting tube portion, the contact of fingers with the other side surface of the terminal body can be prevented even if the other side edge covering portion becomes shorter than the one side edge covering portion due to the shifted retaining recesses.

Effect of the Invention

According to the technique disclosed by this specification, it is possible to suppress the detachment of a terminal protecting portion in a terminal member.

DETAILED DESCRIPTION TO EXECUTE THE INVENTION

First Embodiment

A first embodiment of the technique disclosed in this specification is described with reference to FIGS. 1 to 8.

Figure 3:
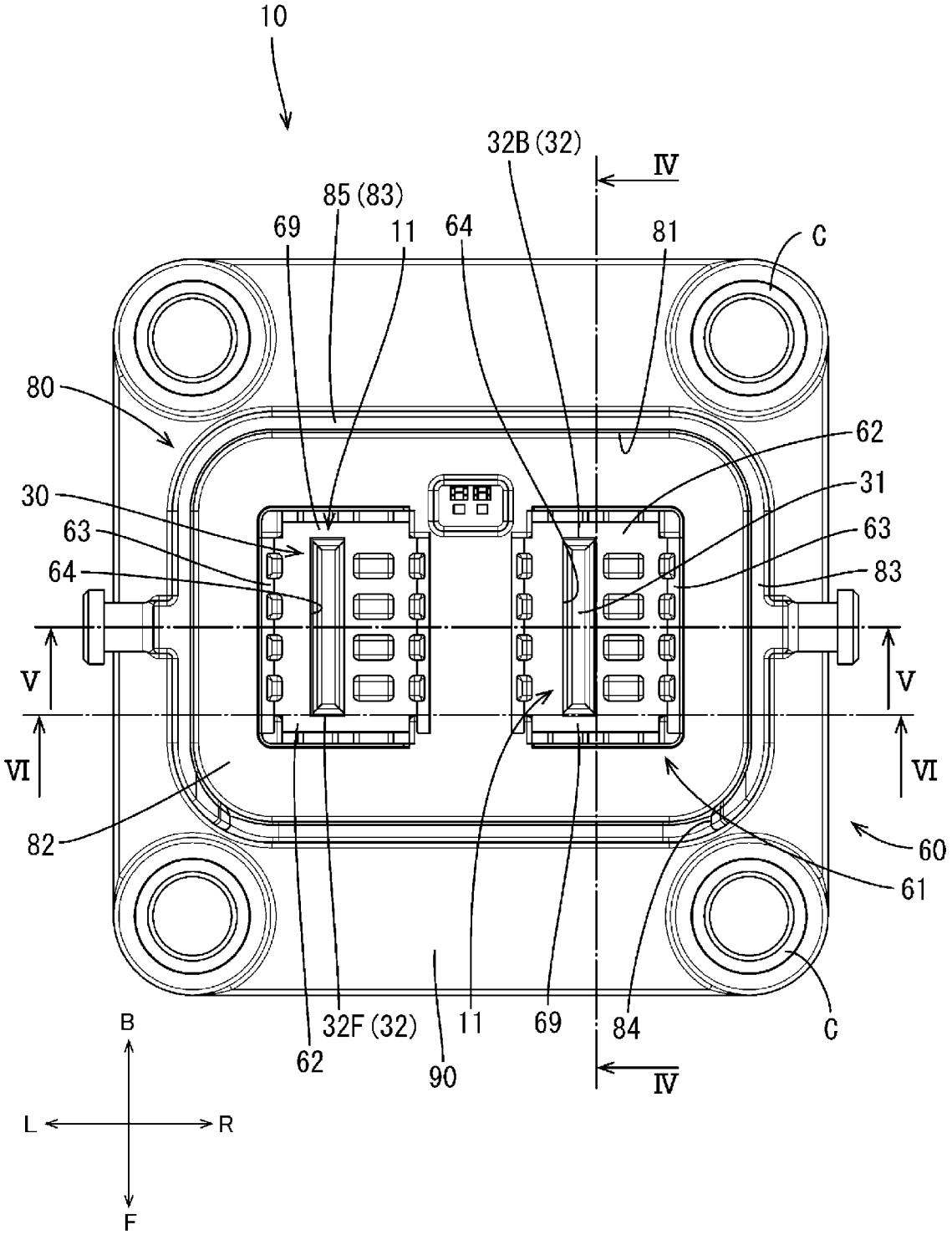
FIG. 3 is a plan view of the device connector.
Figure 4:
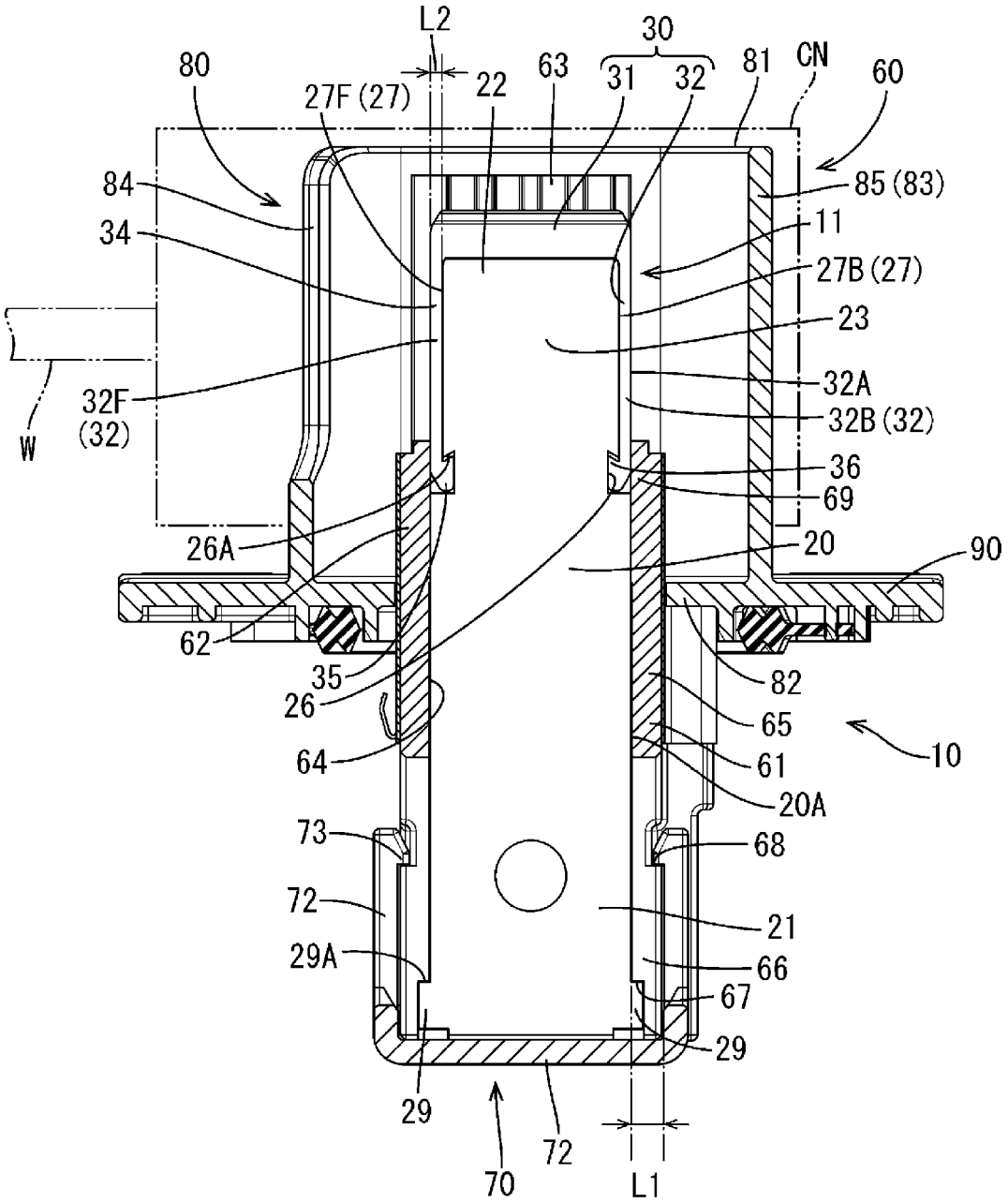
FIG. 4 is a section along IV-IV of FIG. 3.

A connector in this embodiment is illustrated as a device connector (an example of a "connector") 10 to and from which a wire-side connector (an example of a "mating connector") CN having wires W pulled out forward therefrom is connected and separated in a vertical direction as shown in FIG. 4. The device connector 10 is fixed to an unillustrated device installed in a vehicle. Note that, in the following description, the vertical direction is based on U- and D-directions in FIG. 2, wherein the U-direction is an upward direction and the D-direction is a downward direction. A front-back direction is based on F- and B-directions in FIGS. 1 and 3, wherein the F-direction is a forward direction and the B-direction is a backward direction. Further, a lateral direction is based on L- and R-directions in FIGS. 1 and 3, wherein the L-direction is a leftward direction and the R-direction is a rightward direction.

The device connector 10 includes a pair of terminal members 11 to which unillustrated terminals of the wire-side connector CN are to be connected, and a housing 60 separate from the pair of terminal members 11.

Figure 7:
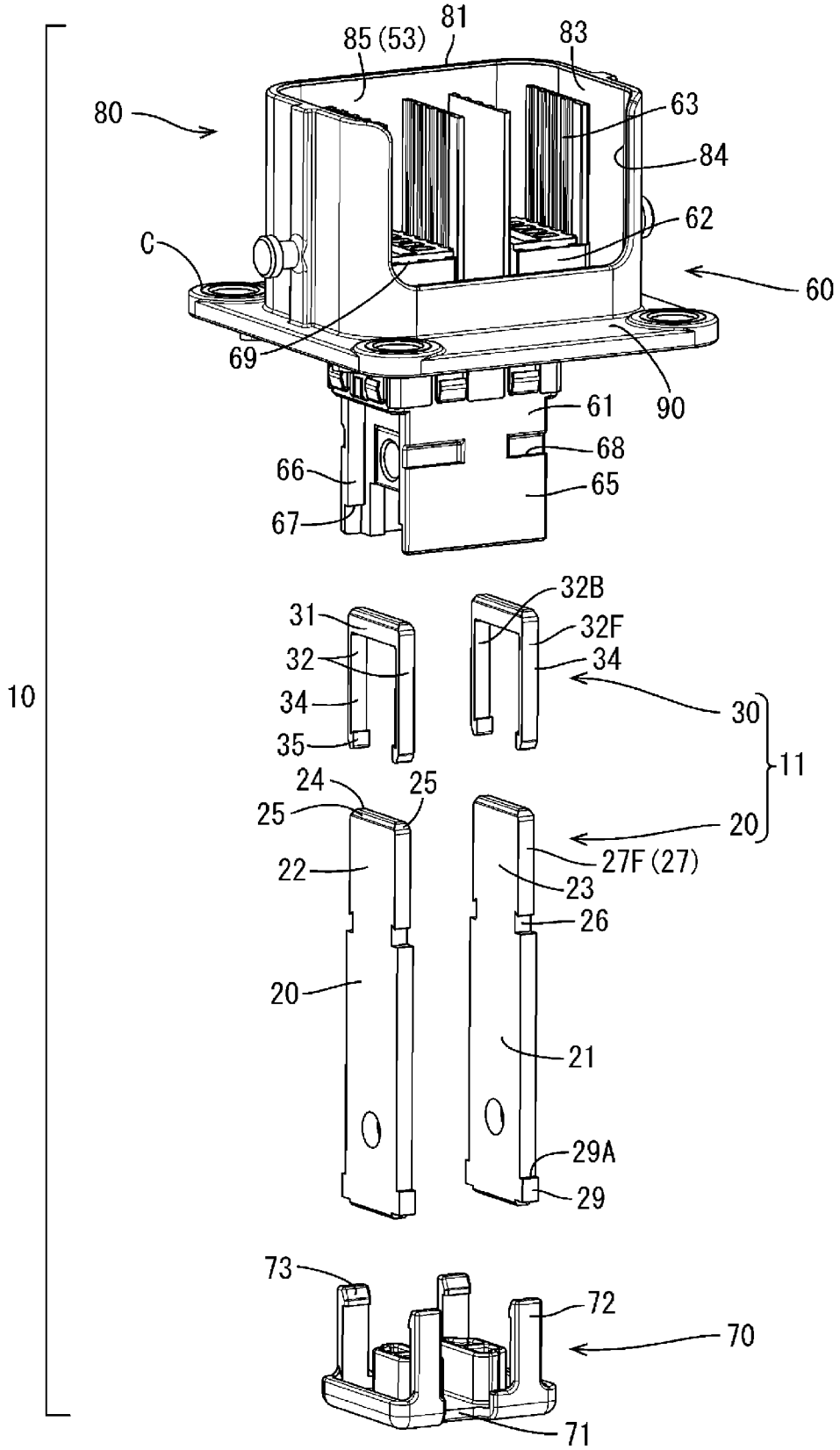
FIG. 7 is an exploded perspective view of the device connector.
Figure 8:
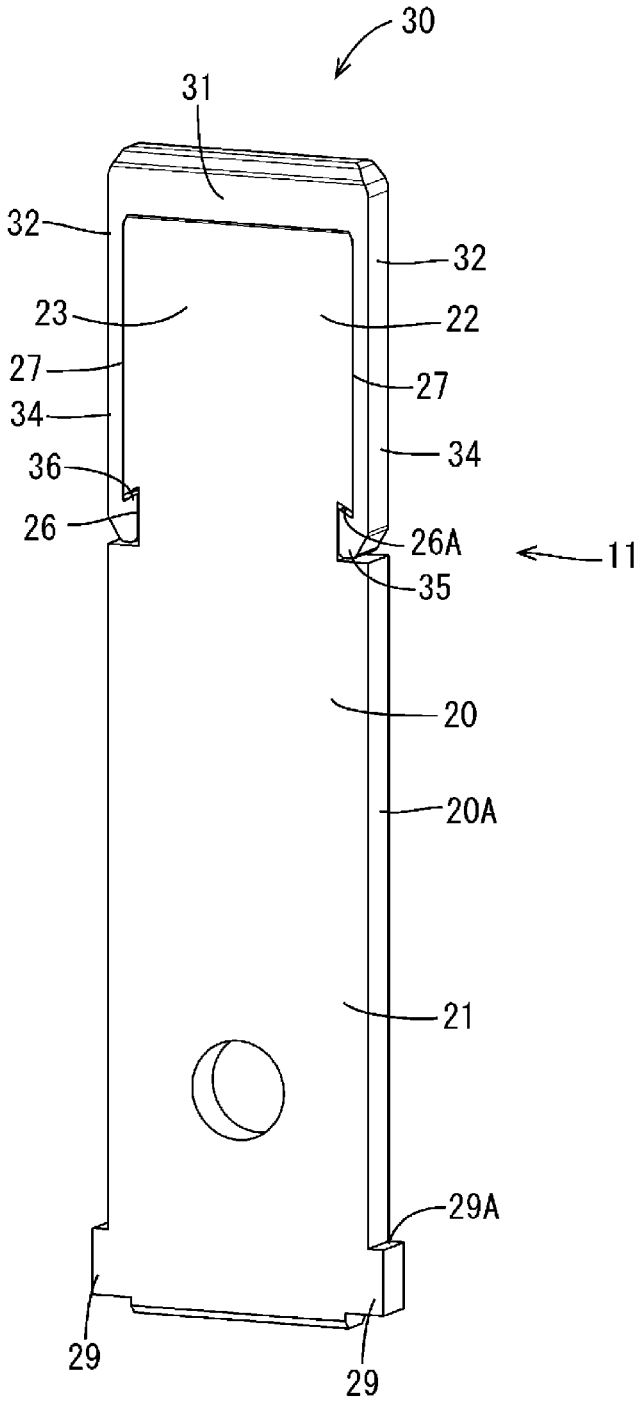
FIG. 8 is a perspective view of a terminal member.

As shown in FIGS. 7 and 8, each terminal member 11 is long in the vertical direction and includes a terminal body 20 in the form of a flat plate and a terminal protecting portion 30 covering a part of the terminal body 20.

The terminal body 20 is formed of conductive metal. The terminal body 20 is in the form of a flat plate long in the vertical direction and having a plate thickness in the lateral direction smaller than a width in the front-back direction.

Figure 1:
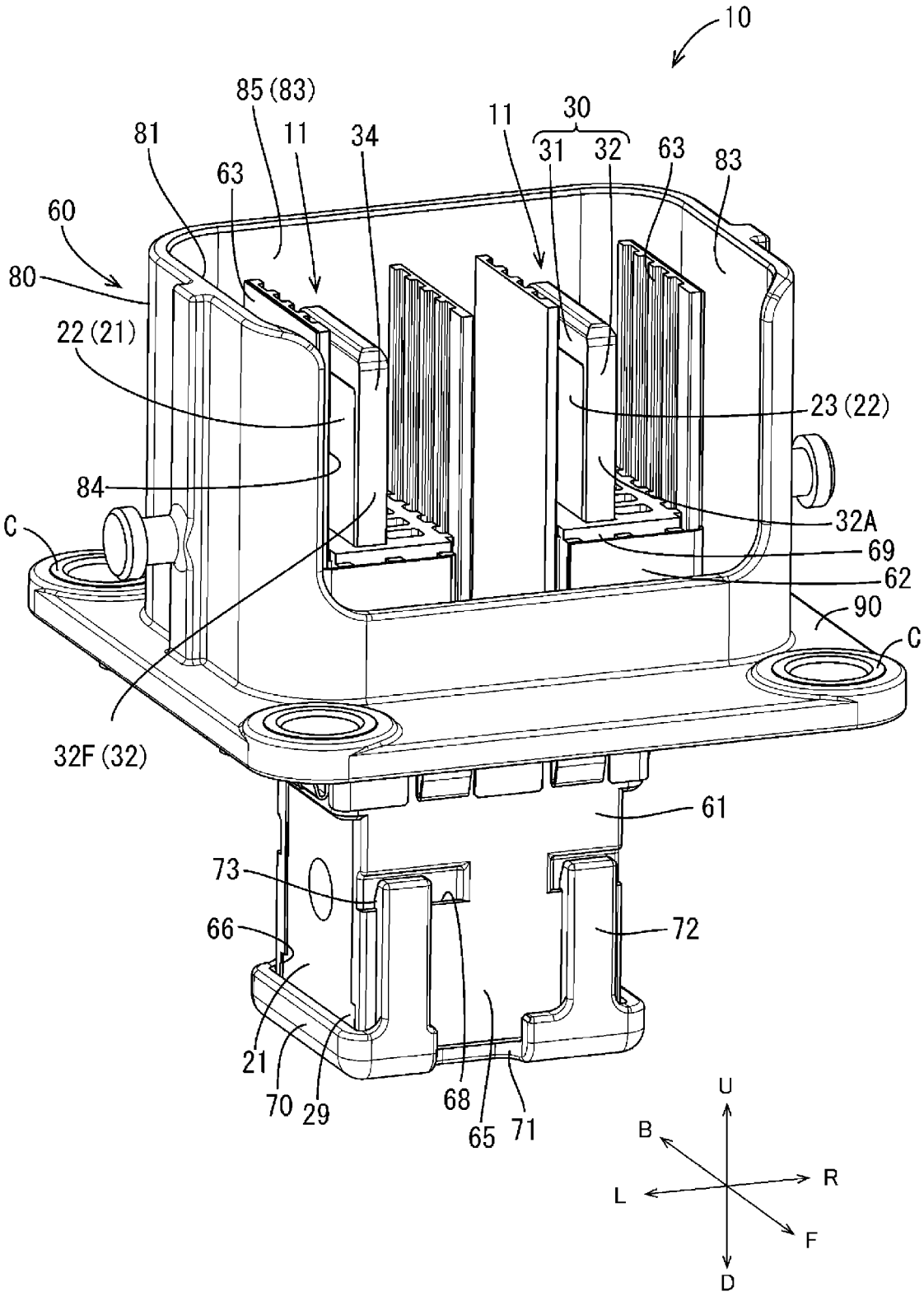
FIG. 1 is a perspective view of a device connector according to a first embodiment.
Figure 2:
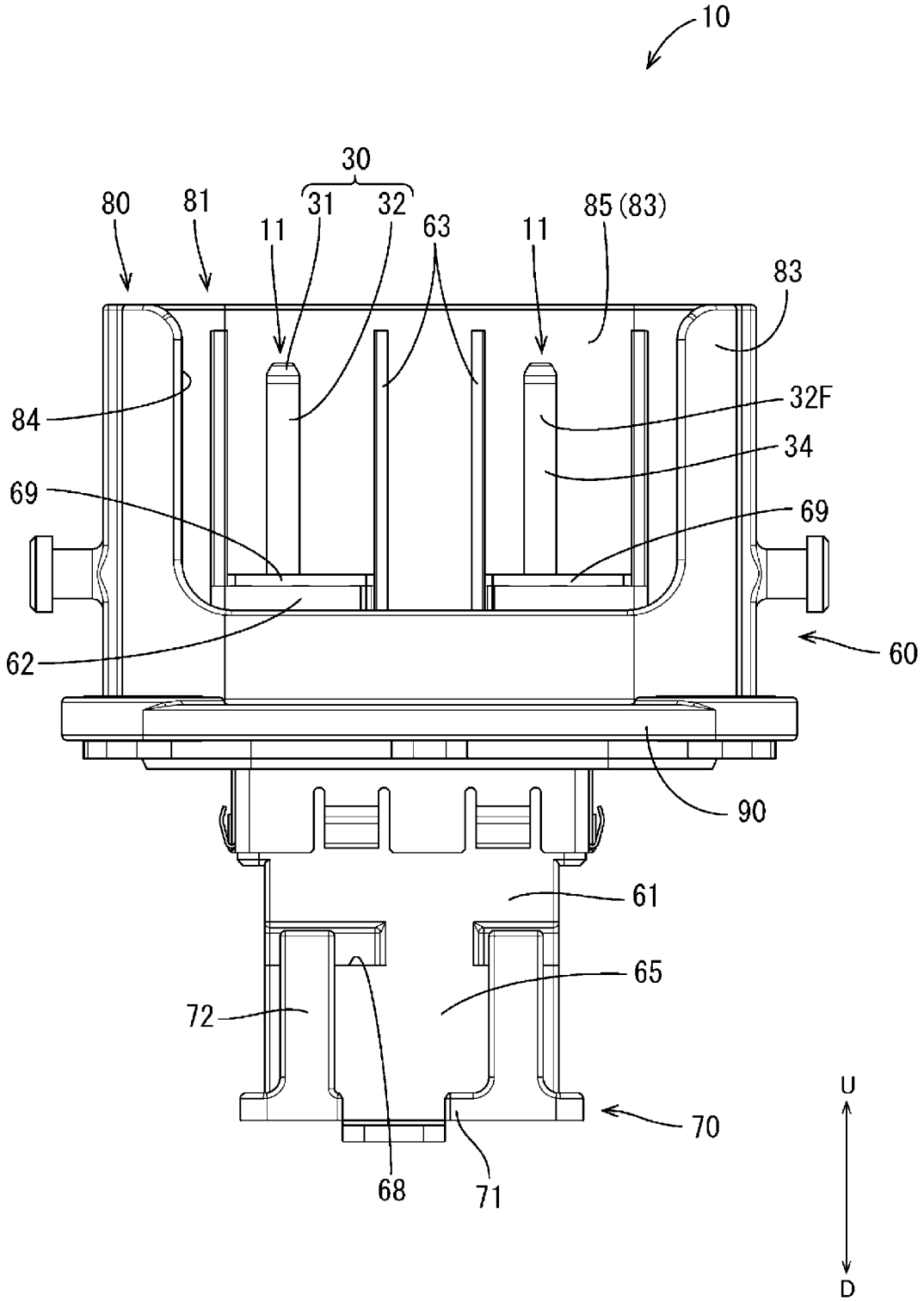
FIG. 2 is a front view of the device connector.

As shown in FIGS. 1 and 4, a lower end part of the terminal body 20 serves as a device-side connecting portion 21 to be bolted to an unillustrated connecting portion provided in the device when the device connector 10 is fixed to the device.

An upper part of the terminal body 20 serves as a terminal connecting portion 22 to which the terminal of the wire-side connector CN is connectable.

Both side surfaces of the terminal connecting portion 22 in the lateral direction, which is a plate thickness direction, serve as connection surfaces 23 to which the terminal is to be connected, and the insulating terminal protecting portion 30 is assembled with the terminal connecting portion 22 from above.

Further, the terminal connecting portion 22 is formed to be narrower in the front-back direction than a part of the terminal body 20 located below the terminal connecting portion 22. An upper end part, which is a projecting end part, of the terminal connecting portion 22 is formed into a tapered portion 24 by a total of four inclined surfaces 25 including two inclined surfaces 25 inclined in the lateral direction, which is the plate thickness direction, toward an upper end and two inclined surfaces 25 inclined in the front-back direction, which is a width direction, toward the upper end as shown in FIG. 7.

As shown in FIG. 4, retaining recesses 26 into which retaining portions 35 projecting on the terminal protecting portion 30 to be described later are fit are respectively provided in a lower end part of the terminal connecting portion 22.

The both retaining recesses 26 are formed by recessing both side surfaces 27 in the front-back direction of the terminal connecting portion 22, and the inner upper surfaces of the respective retaining recesses 26 are formed into inclined surfaces 26A extending obliquely upward toward each other. Thus, the shapes of the respective retaining recesses 26 viewed from the lateral direction expand upward toward each other.

On the other hand, locked portions 29 projecting in the front-back direction are provided on both front and back parts on a lower end part of the device-side connecting portion 21. The locked portion 29 is substantially in the form of a rectangular parallelepiped and the upper surface thereof is formed into a locked surface 29A.

The terminal protecting portion 30 is formed of insulating resin. The terminal protecting portion 30 includes an upper end covering portion 31 to be fit to the tapered portion 24 of the terminal connecting portion 22 from above and a pair of side edge covering portions 32 for covering the both side surfaces 27 in the front-back direction of the terminal connecting portion 22.

As shown in FIGS. 1 to 5, the upper end covering portion 31 is somewhat thick by being wide in the front-back direction. A length in the front-back direction of the upper end covering portion 31 is longer than that of the terminal connecting portion 22, and a thickness in the lateral direction of the upper end covering portion 31 is substantially equal to a thickness of the terminal connecting portion 22.

Figure 5:
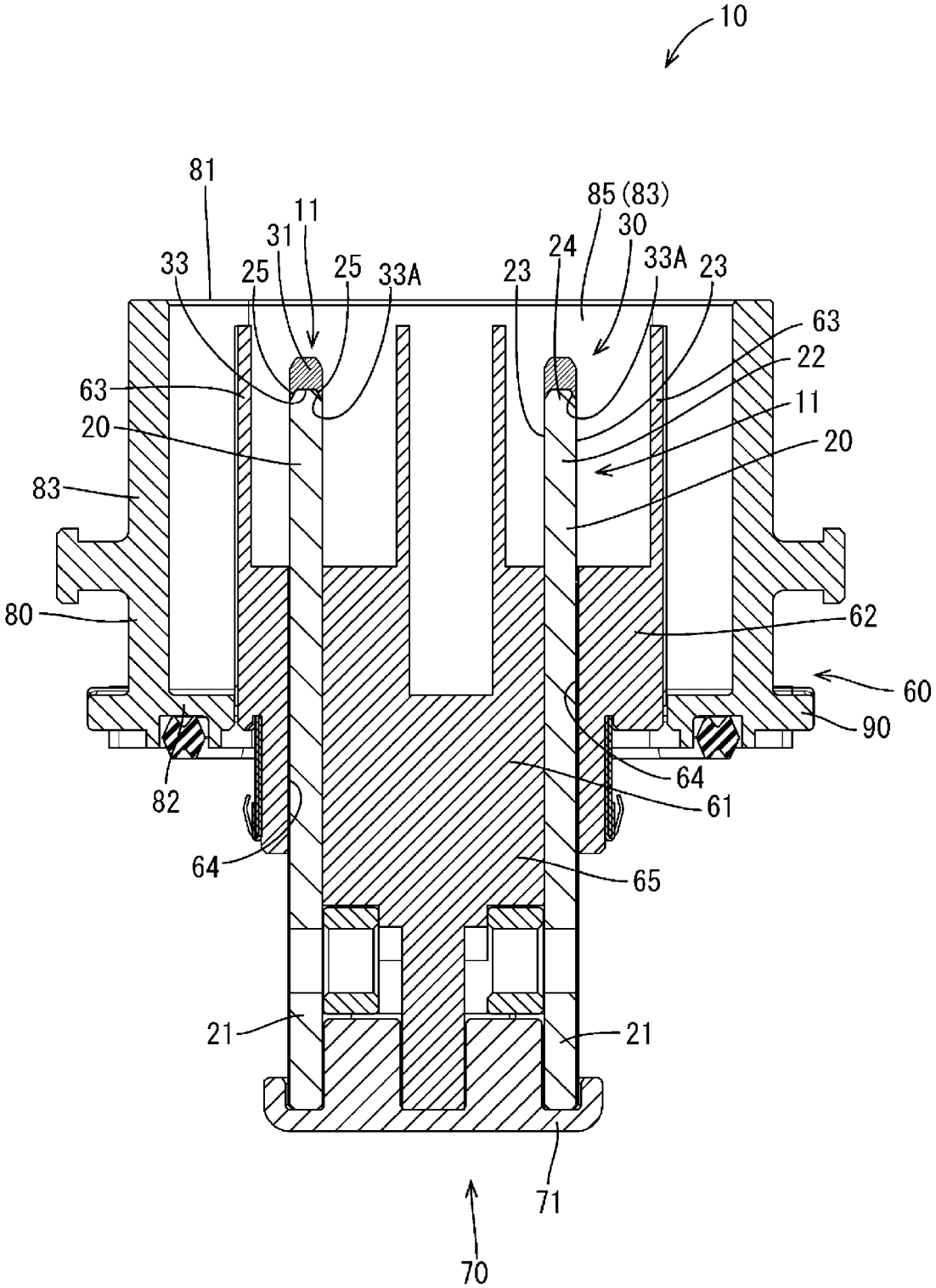
FIG. 5 is a section along V-V of FIG. 3.

The pair of side edge covering portions 32 extending downward are respectively formed on both end parts in the front-back direction of the upper end covering portion 31. A lower end part of the upper end covering portion 31 is formed into a fitting recess 33 to which the tapered portion 24 of the terminal connecting portion 22 is to be fit from below as shown in FIG. 5. The fitting recess 33 has a substantially rectangular shape open downward between the pair of side edge covering portions 32 and is formed to be concave upward.

The fitting recess 33 has four inner inclined surfaces 33A inclined inward toward an upper side from the lower end part of the fitting recess 33. When the terminal protecting portion 30 is assembled with the terminal connecting portion 22, the tapered portion 24 is fit into the fitting recess 33 from below and the four inner inclined surface 33A and the inclined surfaces 25 of the tapered portion 24 are held in surface contact.

That is, if the tapered portion 24 of the terminal body 20 is fit into the fitting recess 33, the tapered portion 24 is covered by the upper end covering portion 33 of the terminal protecting portion 30 from above and a displacement of the upper end covering portion 31 in the lateral direction, which is a thickness direction, is suppressed by the tapered portion 24 as shown in FIGS. 4, 5 and 8.

As shown in FIGS. 4 and 8, the pair of side edge covering portions 32 include rectangular parallelepiped covering portion bodies 34 both linearly extending downward from the upper end covering portion 31 along the side surfaces 27 in the front-back direction of the terminal connecting portion 22, and the covering portion bodies 34 are resiliently deformable in the lateral direction away from each other.

A length in the vertical direction of each covering portion body 34 is set to be substantially equal to a length of the terminal connecting portion 22, and a thickness in the lateral direction thereof is set to be substantially equal to the thickness in the lateral direction of the terminal connecting portion 22.

The covering portion bodies 34 are disposed in surface contact with the side surfaces 27 in the front-back direction of the terminal connecting portion 22 and outer side surfaces 32A in the front-back direction of the side edge covering portions 32 and side surfaces 20A in the front-back direction of the terminal body 20 are set to be flush as shown in FIG. 4 when the terminal protecting portion 30 is assembled with the terminal connecting portion 22.

That is, if the terminal protecting portion 30 is assembled with the terminal connecting portion 22, the both side surfaces 27 in the front-back direction of the terminal connecting portion 22 are covered from both sides in the front-back direction by the pair of side edge covering portions 32 of the terminal protecting portion 30.

As shown in FIGS. 4 and 8, the retaining portions 35 fittable into the retaining recesses 26 of the terminal connecting portion 22 are respectively provided on lower end parts of the respective covering portion bodies 34 (example of tip parts of the side edge covering portions 32). The both retaining portions 35 project inward toward each other, and upper end parts thereof are formed into retaining projections 36 projecting upward toward inner sides.

The retaining projections 36 come into contact with the both side surfaces 37 in the front-back direction of the terminal connecting portion 22 and ride on the terminal connecting portion 22 by the resilient deformation of the covering portion bodies 34 when the terminal protecting portion 30 is mounted on the terminal connecting portion 22. When the terminal protecting portion 30 is assembled at a proper position with the terminal connecting portion 22, the retaining portions 35 including the retaining projections 36 are accommodated in the retaining recesses 26, the covering portion bodies 34 resiliently return and the retaining recesses 26 and the retaining portions 35 are fit.

Further, when the retaining recesses 26 and the retaining portions 35 are fit, the retaining projections 36 are disposed to closely face the inclined surfaces 26A of the retaining recesses 26 and the terminal protecting portion 30 is assembled with the terminal connecting portion 22 while being prevented from escaping upward by the contact of the retaining projections 36 with the inclined surfaces 26A of the retaining recesses 26 in the vertical direction.

The housing 60 is formed of insulating synthetic resin and includes, as shown in FIG. 1, a terminal holding portion 61 for holding the terminal members 11 projecting upward, a tubular fitting tube portion 80 into which the wire-side connector CN is to be fit from above, and a mounting plate 90 provided on the outer peripheral surface of the fitting tube portion 80.

Figure 6:
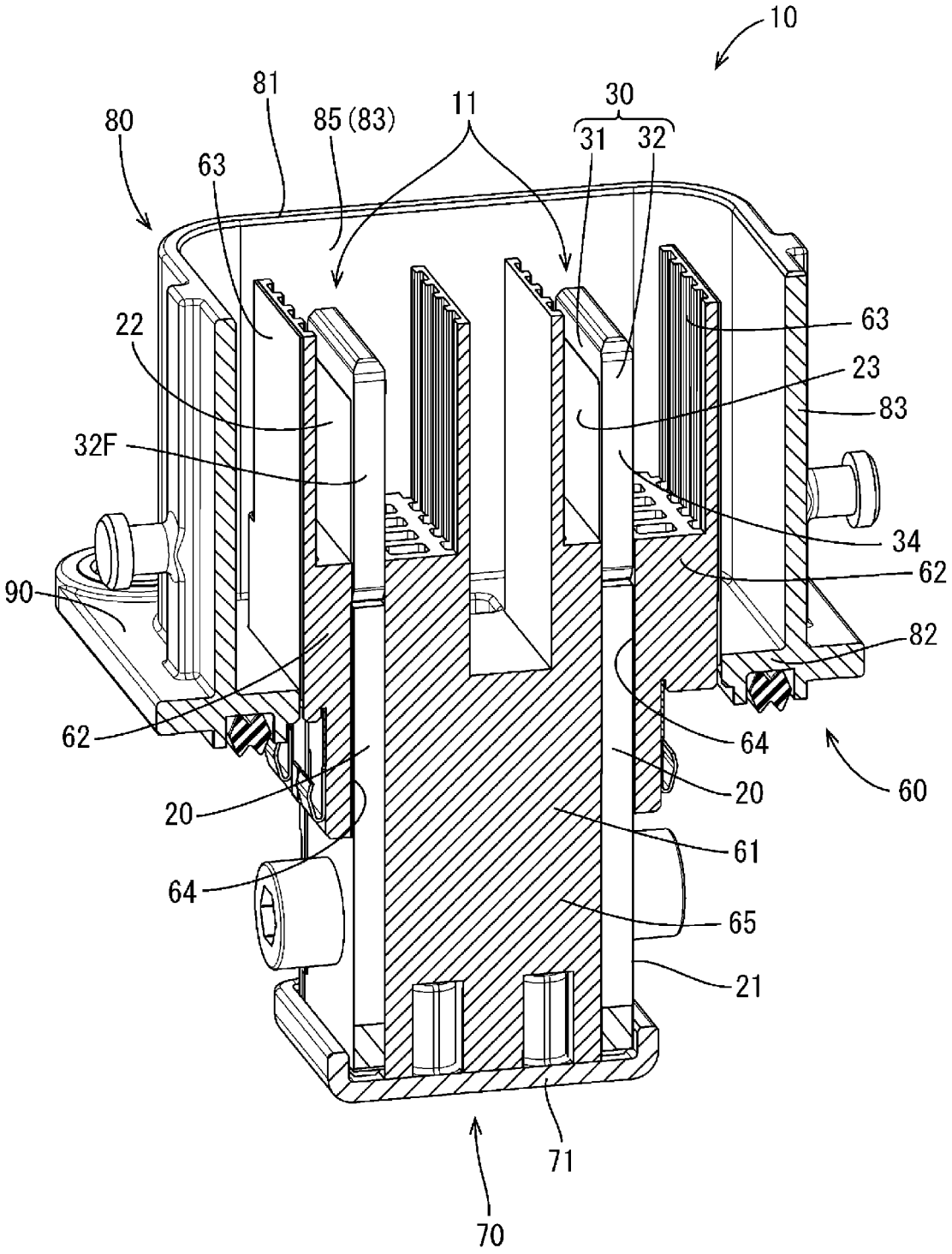
FIG. 6 is a perspective view in section along VI-VI of FIG. 3.

As shown in FIGS. 5 to 7, the terminal holding portion 61 is in the form of a substantially rectangular block somewhat long in the vertical direction and provided at a position where the wire-side connector CN is to be connected. An upper part of the terminal holding portion 61 is formed into a pair of pedestal portions 62 projecting upward, and a pair of side surface protecting portions 63 extending upward are provided on both side edge parts in the lateral direction of each pedestal portion 62. The side surface protecting portions 63 are in the form of rectangular flat plates wide in the front-back direction. The side surface protecting portions 63 are disposed along the connection surfaces 23 to cover the connection surfaces 23 exposed from the terminal protecting portion 30 in the terminal body 20 from both sides in the lateral direction, and clearances in the lateral direction between the terminal member 11 and the side surface protecting portions 63 are set to be smaller than dimensions of fingers.

That is, even if fingers approach the terminal member 11 from above in a connecting direction of the wire-side connector CN, it is possible to prevent the contact of the fingers with the connection surfaces 23 of the terminal body 20 due to the interference of the fingers with the upper end covering portion 31 and the side edge covering portions 32 of the terminal protecting portion 30.

Further, as shown in FIGS. 4 to 6, the terminal holding portion 61 is provided with a pair of terminal insertion recesses 64 into which the terminal members 11 are inserted and fit from below. The pair of terminal insertion recesses 64 are formed to penetrate through the terminal holding portion 61 in the front-back direction, and open in the upper surface of the pedestal portions 62.

As shown in FIG. 3, openings of the terminal insertion recesses 64 in the pedestal portions 62 have substantially the same shape as the outer shape of the terminal members 11 viewed from above, and the terminal members 11 are matched and fit into the terminal insertion recesses 64.

A part of the terminal holding portion 61 below the pedestal portions 62 serves as a holding portion body 65 as shown in FIG. 5. When the terminal members 11 are fit into the terminal insertion recesses 64 and reach proper positions, the device-side connecting portions 21 of the terminal bodies 20 are exposed downward through openings of the holding portion body 65 as shown in FIG. 1.

The device-side connecting portions 21 exposed from the holding portion body 65 are disposed along both side surfaces in the lateral direction of the holding portion body 65.

Further, terminal locking portions 66 are provided on lower end parts of both sides in the lateral direction of the holding portion body 65 as shown in FIG. 4.

As shown in FIG. 7, the terminal locking portions 66 are formed into a substantially rectangular shape in a side view on both end parts in the front-back direction of the holding portion body 65, and the lower inner surfaces of the terminal locking portions 66 are formed into locking surfaces 67 facing downward.

The terminal locking portions 66 come into contact with the locked surfaces 29A of the locked portions 29 of the terminal body 20 and can position the terminal member 11 at a proper position with respect to the terminal holding portion 61 as shown in FIG. 4 when the terminal member 11 is fit into the terminal insertion recess 64 and reaches a proper position with respect to the terminal holding portion 61. Further, the terminal member 11 is prevented from escaping upward from the terminal holding portion 61 and held at the proper position with respect to the terminal holding portion 61 by the contact of the locked surfaces 29A of the locked portions 29 and the locking surfaces 67 of the terminal locking portions 66 in the vertical direction.

Further, as shown in FIGS. 1 and 6, a retainer 70 formed of insulating resin is mounted on a lower end part of the holding portion body 65 from below. The retainer 70 is provided with four resilient locking pieces 72 on side edges of a plate portion 71 to be assembled with the lower surface of the holding portion body 65.

Projections 73 capable of contacting projection receiving portions 68 provided on both side surfaces in the front-back direction of the holding portion body 65 are provided on the tips of the four resilient locking pieces 72. The projections 73 are engaged with the projection receiving portions 68 in the vertical direction to stop the projection receiving portions 68 when the retainer 70 is mounted on the lower end part of the holding portion body 65, whereby the retainer 70 is fixed to the lower end part of the holding portion body 65. In this way, the plate portion 71 is assembled with the lower surface of the holding portion body 65 and, as shown in FIGS. 4 to 6, the terminal members 11 are prevented from escaping downward from the terminal insertion recesses 64 of the terminal holding portion 61.

On the other hand, the fitting tube portion 80 is provided in a substantially vertically central part of the terminal holding portion 61 to be connected to the outer peripheral surface of the terminal holding portion 61 as shown in FIGS. 1 to 7. The fitting tube portion 80 is in the form of a receptacle having a fitting opening 81 open upward in the connecting direction of the wire-side connector CN, and includes a back wall 82 protruding over the entire periphery from the outer peripheral surface of the terminal holding portion 61 and a side wall portion 83 extending upward from the back wall 82 toward the wire-side connector CN to surround an upper part of the terminal holding portion 61.

The side wall portion 83 is formed to cover the terminal members 11 held in the terminal holding portion 61 from three directions, i.e. leftward, rightward and backward directions and includes a side opening 84 open forward in a direction orthogonal to the connecting direction of the wire-side connector CN.

The side opening 84 communicates with the fitting opening 81 of the fitting tube portion 80 and the wire-side connector CN is fit into the side opening from above when the device connector 10 and the wire-side connector CN are connected.

A part of the side wall portion 83 disposed behind the terminal members 11 serves as a back wall portion 85 for covering the back side surfaces 27B of the terminal connecting portions 22 in the terminal bodies 20 as shown in FIG. 4, and a clearance in the front-back direction between the back side edge covering portions 32B, which are the side edge covering portions 32 on a back side in the terminal members 11, and the back wall portion 85 is set to be smaller than dimensions of fingers.

Accordingly, even if fingers approach the terminal members 11 from above in the connecting direction of the wire-side connector CN, it is possible to prevent the contact of the fingers with the connection surfaces 23 of the terminal bodies 20 due to the interference of the fingers with the back side edge covering portions 32B of the terminal protecting portions 30 and the back wall portion 85.

Further, as shown in FIG. 1, the fitting tube portion 80 is provided with the mounting plate 90 on a lower end part of the side wall portion 83. The mounting plate 90 is formed to protrude over the entire periphery from a lower end part of the fitting tube portion 80. The mounting plate 90 is substantially in the form of a rectangular plate, and metal collars C are embedded in corner parts of the mounting plate 90. Unillustrated fixing bolts are insertable into the metal collars C. The fixing bolts are inserted into the metal collars C and tightened into the device, whereby the device connector 10 is fixed to the device.

The side edge covering portions 32 of the terminal member 11 are matched and fit into the terminal insertion recess 64 as shown in FIGS. 4 and 6 with the terminal member 11 fit in the terminal insertion recess 64 and assembled with the terminal holding portion 61. Thus, the side edge covering portions 32 mounted on the terminal body 20 are prevented from being shifted in position in the lateral direction by the contact of the side edge covering portions 32 and the pedestal portion 62 of the terminal holding portion 61 in the front-back and lateral directions, which are directions intersecting the vertical direction.

Further, parts of the pedestal portion 62 of the terminal holding portion 61 covering the side edge covering portions 32 serve as locking wall portions 69, and a thickness L1 of the locking wall portions 69 is set to be larger than a thickness L2 of the side edge covering portions 32 covering the terminal body 20 as shown in FIG. 4. Lower end parts of the side edge covering portions 32 are located inside the pedestal portion 62 of the terminal holding portion 61 and covered by the locking wall portions 69.

This embodiment is configured as described above. Next, functions and effects of the device connector 10 are described.

For example, if a terminal protecting portion is molded around a terminal body by insert molding and, in addition, a housing is also integrally formed with the terminal protecting portion by insert molding, a mold becomes complicated. Further, if the design of either the terminal protecting portion or the housing is changed, a mold for an entire connector has to be newly fabricated.

Accordingly, the present inventor and other researchers found out the configuration of this embodiment as a result of diligent study to solve the above problem. That is, the device connector 10 of this embodiment is a connector to and from which the wire-side connector CN is connectable and separable, and includes the terminal members 11 having the conductive terminal bodies 20 and the insulating terminal protecting portions 30 mounted on the terminal bodies 20, and the housing 60 provided separately from the terminal members 11 and having the terminal holding portion 61 for holding the terminal members 11 in a projecting state at a position where the wire-side connector CN is connected. The terminal protecting portion 30 includes the side edge covering portions 32 for covering parts of the side surfaces 27 extending along a projecting direction of the terminal body 20. The terminal holding portion 61 is provided with the terminal insertion recesses 64 through which the terminal members 11 are fit. With the terminal member 11 fit in the terminal insertion recess 64 and assembled with the terminal holding portion 61, the side edge covering portions 32 are so fit in the terminal insertion recess 64 as to be able to contact the terminal holding portion 61 in the front-back and lateral directions intersecting the vertical direction (connecting direction).

That is, according to the device connector 10 of this embodiment, the terminal members 11 and the housing 60 are individually formed and assembled as shown in FIG. 4. Thus, it can be suppressed that molds for forming the respective members become complicated. Further, even if the design of either the terminal members 11 or the housing 60 is changed, the new fabrication of a complicated and large-size mold for forming the entire device connector 10 can be prevented by newly fabricating only either one of the molds for the terminal members 11 and the housing 60.

In the case of separately forming the terminal members 11 and the housing 60 and assembling the terminal members 11 with the housing 60, a prying force acts on side edge parts of the terminal members 11 in connecting and separating the device connector 10 and the wire-side connector CN since the terminal protecting portions 30 of the terminal members 11 and the housing 60 are separate bodies. Thus, there is a concern that the side edge covering portions 32 of the terminal protecting portions 30 are detached from the terminal bodies 20.

However, according to the device connector 10 of this embodiment, the side edge covering portions 32 covering the side surfaces (side parts) in the front-back direction of the terminal connecting portion 22 in the terminal body 20 are fit in the terminal insertion recess 64 and can contact the terminal holding portion 61 in the front-back and lateral directions as shown in FIGS. 4 and 6 with the terminal member 11 fit in the terminal insertion recess 64 and assembled with the terminal holding portion 61. That is, even if a prying force acts on the side edge covering portions 32 in connecting and separating the device connector 10 and the wire-side connector CN, the detachment of the side edge covering portions 32 of the terminal protecting portion 30 from the terminal body 20 can be suppressed by the contact of the side edge covering portions 32 and the terminal holding portion 61.

Further, since the terminal body 20 projects along the connecting direction to and a separating direction from the wire-side connector CN, a prying force acts on the terminal body 20 in a rotating direction about the connecting and separating directions to connect and separate the wire-side connector CN. Thus, if the terminal body 20 projects along the connecting direction to and the separating direction from the wire-side connector CN as in this embodiment, a technique for suppressing the detachment of the terminal protecting portion 30 from the terminal body 20 by the contact of the side edge covering portions 32 with the terminal holding portion 61 is very effective.

The terminal body 20 is in the form of a plate having a plate thickness smaller than a width, and the terminal protecting portion 30 further includes the upper end covering portion 31 to be fit to the tapered portion 24 (projecting end part) of the terminal body 20, and the side edge covering portions 32 are respectively provided on the both side surfaces 27 in the width direction in the terminal body 20 to be connected to the upper end covering portion 31.

If the plate thickness of the terminal body 20 is smaller than the width thereof as in this embodiment, the side edge covering portions 32 provided on the side surfaces 27 in the width direction of the terminal body 20 are easily detached from the terminal body 20.

However, since the side edge covering portions 32 can contact the terminal holding portion 61 in the front-back and lateral directions, even if a prying force acts on the side edge covering portions 32, the detachment of the side edge covering portions 32 from the terminal body 20 can be suppressed.

Further, the lower end parts of the respective side edge covering portions 32 in contact with the terminal holding portion 61 are located inside the pedestal portion 62 of the terminal holding portion 61. By protecting the lower end parts of the side edge covering portions 32 by the pedestal portion 62, the contact of external matters with the relatively easily deformable lower end parts of the side edge covering portions 32 is suppressed. As a result, the deformation of the lower end parts of the side edge covering portions 32 is suppressed, wherefore the detachment of the side edge covering portions 32 from the terminal body 20 is suppressed.

Further, the retaining portions 35 project on the lower end parts of the side edge covering portions 32, and the retaining recesses 26 into which the retaining portions 35 are fit are recessed on the both side surfaces 27 of the terminal body 20. Since the retaining portions 35 to be fit into the retaining recesses 26 provided in the terminal body 20 are provided on the relatively easily deformable lower end parts of the side edge covering portions 32, the detachment of the lower end parts of the side edge covering portions 32 from the terminal body 20 is suppressed. Therefore, the detachment of the side edge covering portions 32 from the terminal body 20 is further suppressed.

Further, since the upper end parts opposite to the lower end parts to be held in contact with the terminal holding portion 61 in the respective side edge covering portions 32 are formed to be connected to the upper end covering portions 31 to be fit to the tapered portions 24 of the terminal body 20, the detachment of the side edge covering portions 32 from the terminal body 20 can be further suppressed.

Further, according to this embodiment, the terminal member 11 includes the locked portions 29 for preventing the terminal member 11 from escaping upward toward the wire-side connector by contacting the terminal locking portions 66 provided on the terminal holding portion 61 when the terminal member 11 reaches a proper fitting position with respect to the terminal insertion recess 64.

Accordingly, the terminal member 11 can be retained at a proper position with respect to the terminal holding portion 61 of the housing 60 and the side edge covering portions 32 can be reliably fit into the terminal insertion recess 64. In this way, the detachment of the side edge covering portions 32 of the terminal protecting portion 30 from the terminal body 20 can be reliably suppressed.

Further, the thickness L1 in the front-back direction of the locking wall portions (wall portions) 69 for covering the terminal member 11 in the terminal insertion recess 64 is set to be larger than the thickness L2 of the side edge covering portions 32 covering the terminal body 20.

That is, since the thickness L1 of the locking wall portions 69 for covering the terminal member 11 in the terminal insertion recess 64 is larger than the thickness L2 of the side edge covering portions 32, even if a prying force acts on the side edge covering portions 32, the terminal holding portion 61 can firmly receive the side edge covering portions 32. In this way, the detachment of the side edge covering portions 32 from the terminal body 20 can be reliably suppressed.

Further, the housing 60 of this embodiment includes the receptacle-like fitting tube portion 80 connected to the terminal holding portion 61 and having the fitting opening 81 into which the wire-side connector CN is to be fit, and the fitting tube portion 80 includes the side opening 84 communicating with the fitting opening 81 and open forward, i.e.

a direction toward one end of the terminal body 20 in the front-back direction (width direction).

If the fitting tube portion 80 includes the side opening 84 communicating with the fitting opening 81 as in this embodiment, there is a concern that a larger prying force acts on the side edge covering portions 32 than, for example, with a fitting tube portion including only a fitting opening, when the wire-side connector CN is connected and separated.

However, the side edge covering portions 32 are fit into the terminal insertion recess 64 and the terminal holding portion 61 stops the side edge covering portions 32 by contacting and engaging the side edge covering portions 32 in this embodiment. This is very effective in suppressing the detachment of the side edge covering portions 32 even if the fitting tube portion 80 includes the side opening 84.

Further, in this embodiment, with the terminal member 11 fit in the terminal insertion recess 64 and assembled with the terminal holding portion 61, both of the pair of side edge covering portions 32 are matched and fit in the terminal insertion recess 64. Thus, the detachment of the side edge covering portions 32 from the terminal body 20 when a prying force acts on the side edge covering portions 32 can be suppressed, for example, as compared to the case where only one of the pair of side edge covering portions is fit in the terminal insertion recess.

Second Embodiment

Next, a second embodiment is described with reference to FIG. 9.

In a device connector 110 of the second embodiment, the positions of the retaining recesses 26 of the back side surfaces 27B in the terminal connecting portion 22 of the terminal body 20 of the first embodiment are changed and the length of the back side edge covering portion 32B in the terminal protecting portion 30 is changed. Components, functions and effects common to the first embodiment are not described to avoid repeated description. Further, the same components as those of the first embodiment are denoted by the same reference signs.

Figure 9:
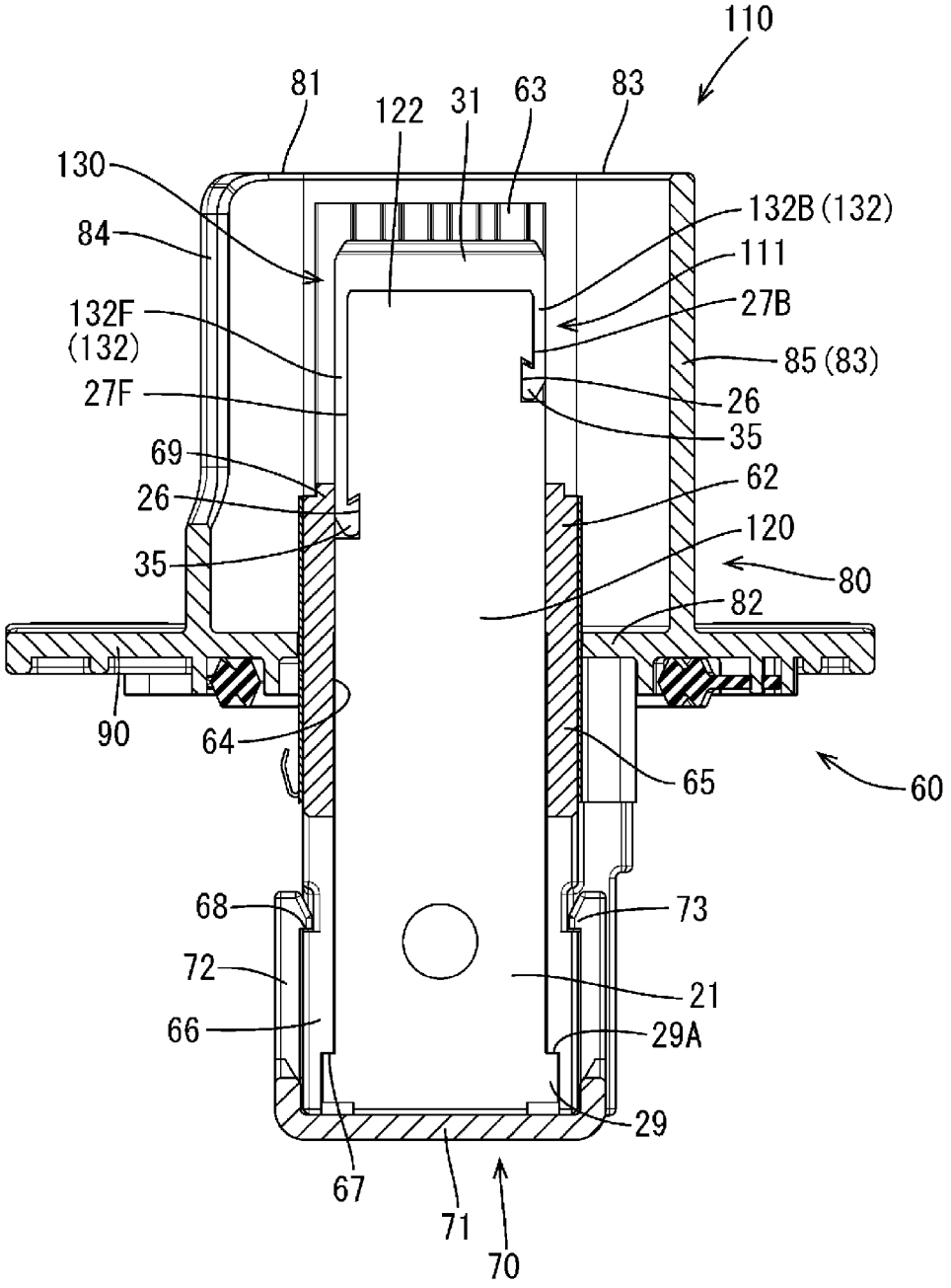
FIG. 9 is a section, corresponding to FIG. 4, of a device connector according to a second embodiment.

In a terminal body 120 in a terminal member 111 of the second embodiment, a retaining recess 26 in a back side surface 27B is arranged above a retaining recess 26 in a front side surface 27 in a terminal connecting portion 122, and the retaining recesses 26 in the both side surfaces 27 of the terminal connecting portion 122 in the terminal body 120 are arranged to be shifted in a vertical direction as shown in FIG. 9.

On the other hand, in a terminal protecting portion 130 to be mounted on the terminal body 120, a back side edge covering portion 132B is formed to be shorter in the vertical direction than a front side edge covering portion 132F, which is a side edge covering portion 132 on a front side, to correspond to the retaining recess 26 in the back side surface 27B of the terminal connecting portion 122, and the retaining portion 35 of the back side edge covering portion 132B and the retaining portion 35 of the front side edge covering portion 132F are arranged to be shifted in the vertical direction.

Accordingly, a lower end part of the back side surface 27B in the terminal connecting portion 122 of the terminal body 120 is not covered from behind by the back side edge covering portion 132B, and a part of the terminal connecting portion 122 located below the back side edge covering portion 132B has a larger cross-sectional area than a part of the terminal connecting portion 122 covered by the back side edge covering portion 132B.

That is, in this embodiment, the fitting tube portion 80 includes a back wall portion (wall portion) 85 for covering the back side surface (another side surface) 27B disposed on a back side opposite to the front side surface (one side surface) 27F disposed on a front side, i.e. on the side of a side opening 84, out of the both side surfaces 27 in the front-back direction (width direction) of the terminal body 120 from behind, which is the other side surface side, and the both side surfaces 27 in the front-back direction (width direction) of the terminal body 120 are respectively provided with the retaining recesses 26 capable of contacting the retaining portions 35 provided on the side edge covering portions 132, the retaining portion 35 of the back side edge covering portion (another edge covering portion) 132B for covering the back side surface (other side surface) 27B of the terminal body 120, out of the pair of side edge covering portions 132, is formed to be shorter in the vertical direction (connecting direction) than the front side edge covering portion (one side edge covering portion) 132F for covering the front side surface (one side surface) 27F of the terminal body 120, out of the pair of side edge covering portions 132, and the both retaining recesses 26 of the terminal body 120 are formed to be shifted in the vertical direction (connecting direction).

If the retaining recesses 26 are respectively recessed on the both side surfaces 27 of the terminal body 120 as in this embodiment, a cross-sectional area of the terminal body in a part where the retaining recesses are provided is reduced, for example, if the retaining recesses are provided at the same position in the vertical direction. Then, electrical resistance in the part of the terminal body having a reduced cross-sectional area increases and the amount of heat generation of the terminal body increases.

However, according to this embodiment, since the retaining recesses 26 in the both side surfaces 27 of the terminal body 120 are formed to be shifted in the vertical direction as shown in FIG. 9, the cross-sectional area of the terminal body 120 in parts where the retaining recesses 26 are provided can be increased, for example, as compared to the case where retaining recesses are provided at the same position in the vertical direction.

That is, an increase in the electrical resistance of the terminal body 120 in the parts where the retaining recesses 26 are provided can be suppressed and an increase in the amount of heat generation in the terminal body 120 can be suppressed, for example, as compared to the case where the retaining recesses are provided at the same position in the vertical direction. Further, since the back side surface 27B of the terminal body 120 is covered from behind by the back wall portion 85 of the fitting tube portion 80, the contact of fingers with the back side surface 27B of the terminal body 120 can be prevented even if the back side edge covering portion 132B is shorter than the front side edge covering portion 132F and the lower end part in the terminal connecting portion 22 of the terminal body 120 is not covered by the back side edge covering portion 132B by locating the retaining recess 26 at an upper position.

Other Embodiments

The technique disclosed in this specification is not limited to the above described and illustrated embodiments and includes, for example, the following various modes.

(1) In the above embodiments, the fitting tube portion 80 includes the side opening 84. However, without limitation to this, a fitting tube portion may include no side opening or may include a side opening also on a back side.

(2) In the above embodiments, the retaining portions 35 formed on the lower end parts of the side edge covering portions 32 are fit into the retaining recesses 26 of the terminal body 20, 120 to mount the terminal protecting portion 30, 130 on the terminal body 20, 120. However, without limitation to this, a terminal protecting portion may be mounted by being press-fit to a terminal body or a terminal protecting portion may be insert-molded on a terminal body.

(3) In the above embodiments, the terminal member 11 is fit by being passed through the terminal insertion recess 64 of the terminal holding portion 61 from below. However, without limitation to this, a terminal member may be fit into a terminal holding portion from above.

LIST OF REFERENCE NUMERALS

10: device connector (example of "connector")
11: terminal member
20: terminal body
24: tapered portion (example of "projecting end part")
26: retaining recess
27: both side surfaces of terminal body
29: locked portion
30: terminal protecting portion
31: upper end covering portion (example of "end covering portion")
32: side edge covering portion
32B: back side edge covering portion (example of "another side edger covering portion")
32F: front side edge covering portion (example of "one side edge covering portion")
35: retaining portion
60: housing
61: terminal holding portion
64: terminal insertion recess
66: terminal locking portion
80: fitting tube portion
81: fitting opening
85: back wall portion (example of "wall portion")
84: side opening
CN: wire-side connector (example of "mating connector")

What is claimed is:

1. A connector to and from which a mating connector is connectable and separable, comprising:

a terminal member including a conductive terminal body and an insulating terminal protecting portion mounted on the terminal body; and a housing provided separately from the terminal member, the housing including a terminal holding portion for holding the terminal member in a projecting state at a position where the mating connector is to be connected, wherein:

the terminal protecting portion includes a side edge covering portion for partially covering a side part extending along a projecting direction of the terminal body, the terminal holding portion is provided with a terminal insertion recess, the terminal member being fit into the terminal insertion recess, the side edge covering portion is so fit in the terminal insertion recess as to be able to contact the terminal holding portion in a direction intersecting a connecting direction with the terminal member fit in the terminal insertion recess and assembled with the terminal holding portion, the housing includes a receptacle-like fitting tube portion connected to the terminal holding portion and having a fitting opening, the mating connector being fit into the fitting opening, the fitting tube portion includes a side opening communicating with the fitting opening and open in a width direction of the terminal body, the fitting tube portion includes a wall portion that covers another side surface of the terminal body disposed opposite to one side surface of the terminal body, out of both side surfaces of the terminal body in the width direction, the one side surface of the terminal body being disposed on a side of the side opening of the fitting tube portion, retaining recesses capable of contacting retaining portions projecting on the side edge covering portions are respectively recessed on the both side surfaces in the width direction of the terminal body, the other side edge covering portion for covering the other side surface of the terminal body, out of the pair of side edge covering portions, is formed to be shorter in the connecting direction than one side edge covering portion for covering the one side surface of the terminal body, out of the pair of side edge covering portions, and the both retaining recesses of the terminal body are formed to be shifted in the connecting direction.

2. The connector of claim 1, wherein the terminal body projects along the connecting direction to and a separating direction from the mating connector.

3. The connector of claim 2, wherein:

the terminal body is in a form of a plate having a plate thickness smaller than a width, the terminal protecting portion further includes an end covering portion to be fit to a projecting end part of the terminal body, and the side edge covering portions are so provided on the side parts on both sides in a width direction of the terminal body as to be connected to the end covering portion.

4. The connector of claim 1, wherein a tip part of the side edge covering portion is located inside the terminal holding portion.

5. The connector of claim 4, wherein a retaining portion projects on the tip part of the side edge covering portion, and a retaining recess capable of contacting the retaining portion is recessed on the side part of the terminal body.

6. The connector of claim 1, wherein the terminal member includes a locked portion for preventing the terminal member from escaping toward the mating connector by contacting a terminal locking portion provided on the terminal holding portion when the terminal member reaches a proper fitting position with respect to the terminal insertion recess.

7. The connector of claim 1, wherein a thickness in a front-back direction of a wall portion for covering the terminal member in the terminal insertion recess is set to be larger than a thickness of the side edge covering portion covering the terminal body.

* * * * *